US007025153B2

(12) United States Patent
Boutte et al.

(10) Patent No.: US 7,025,153 B2
(45) **Date of Patent: *Apr. 11, 2006**

(54) METHOD FOR HANDLING, PROCESSING AND DISPOSING OF DRILL CUTTINGS

(76) Inventors: Kenneth J. Boutte, 225 Kings Rd., Lafayette, LA (US) 70503; Ban D. Green, 402 Interlude Rd., New Iberia, LA (US) 70563

( * ) Notice: Subject to any disclaimer, the term of this patent is extended or adjusted under 35 U.S.C. 154(b) by 0 days.

This patent is subject to a terminal disclaimer.

(21) Appl. No.: 10/116,544

(22) Filed: Apr. 3, 2002

(65) Prior Publication Data

US 2003/0006202 A1 Jan. 9, 2003

Related U.S. Application Data

(63) Continuation-in-part of application No. 09/900,264, filed on Jul. 6, 2001, now Pat. No. 6,855,261.

(51) Int. Cl.
*E21B 21/01* (2006.01)
*E21B 21/06* (2006.01)

(52) U.S. Cl. ..... 175/66; 175/206; 175/207
(58) Field of Classification Search ..... 166/75.12; 175/66, 206, 207

See application file for complete search history.

(56) References Cited

U.S. PATENT DOCUMENTS 4,242,146 A * 12/1980 Kelly, Jr. ..... 175/206
4,439,069 A * 3/1984 Kelly et al. ..... 175/66
4,480,702 A 11/1984 Kelly, Jr.
5,361,998 A * 11/1994 Sirevag et al. ..... 241/79.1
5,405,223 A * 4/1995 Sirevag ..... 175/206
5,842,529 A * 12/1998 Dietzen ..... 175/66
5,964,304 A * 10/1999 Morrison et al. ..... 175/38
6,386,026 B1 * 5/2002 Zamfes ..... 175/44
6,530,438 B1 * 3/2003 McIntyre ..... 175/66
6,585,115 B1 * 7/2003 Reddoch et al. ..... 175/206

FOREIGN PATENT DOCUMENTS

WO WO 200120122 A1 * 3/2001

* cited by examiner

*Primary Examiner*—David Bagnell
*Assistant Examiner*—Shane Bomar
(74) *Attorney, Agent, or Firm*—William W. Stagg

(57) ABSTRACT

A method and apparatus for handling, processing and disposing the drill cuttings removed from the drilling mud of oil and gas well drilling rigs is disclosed. The apparatus and method utilize a shaker for separating drill cuttings from the mud, conduit for transporting the drill cuttings so separated to an extruder where the separated cuttings are compacted into a plurality of discrete compacted pellet-like bodies. The pellets substantially reduce the volume of drill cuttings. There is also a substantial reduction in the retained fluid volume, including the volume of environmentally harmful fluids, after the cuttings are compacted. Once extruded into pellets, the pelletized drill cuttings are transported to a desired end location that may include dumping the pellets offshore.

26 Claims, 1 Drawing Sheet

METHOD FOR HANDLING, PROCESSING AND DISPOSING OF DRILL CUTTINGS

This is a continuation-in-part of U.S. patent application Ser. No. 09/900,264 filed by Applicants' on Jul. 6, 2001 now U.S. Pat. No. 6,855,261.

FIELD OF INVENTION

This invention relates to the field of oil and gas exploration and, more particularly, relates to a method for handling, compacting, storing and disposing of drill cuttings at a well location, whether onshore or offshore, so that the cost of handling and disposing the cuttings will be reduced.

BACKGROUND OF THE INVENTION

In rotary drilling for the exploration for oil and gas, a liquid slurry know as drilling mud is utilized for maintenance and lubrication of the borehole created during the drilling operation. Typically the drilling mud system of a well includes a mud holding tank at the well surface located on or adjacent to the drilling rig and a network of pumps, mixers and mud supply lines. During rotary drilling operations, drilling mud is pumped from the mud holding tank, through the mud supply lines, down through the well bore at the desired rate and is returned to the surface of the well bore. The returned drilling mud carries with it drill cuttings from the bottom of the borehole produced as rotary drilling is advanced. When the circulating drilling mud, along with the carried drill cuttings, is returned to the surface, it is delivered to a screening device know as a "shaker" which serves as a sieve for removing the carried drill cuttings from the drilling mud. When the drill cuttings have been removed from the drilling mud by the shaker, the drilling mud is returned to the mud storage tank for reuse. The drill cuttings separated from the drilling mud are collected and conveyed to storage tanks for treating and disposal.

The storage and disposal of drill cuttings produced at a drilling location can present difficult problems. The drill cuttings removed from the borehole are typically comprised of shale, sand, hard clays, or shell and they are often coated with, or contain, residual contaminants from the drilling mud or from the borehole. The drill cuttings and their contaminants present environmental concerns that must be addressed during their disposal. The storage of the drill cuttings at the drill site prior to disposal can also present many problems, particularly on offshore drilling locations where storage space on drilling platforms is limited. The drill cuttings are typically stored on drilling locations in rigid cuttings boxes. These boxes are heavy, bulky and take up valuable platform deck space. Deck space must be allocated not only to cuttings boxes filled with cuttings that have been removed from the borehole but also to cuttings boxes waiting to be filled with drill cuttings that have been removed from the drilling mud.

Transporting the drill cuttings from a rig site to a disposal facility, whether from an onshore or an offshore drilling location, is also a concern because of the costs associated with transporting the bulky, heavy cuttings boxes to and from the well location. In addition, drill cuttings typically contain oil, petroleum distillates, and other environmentally unsuitable contaminates and often must undergo some treatment to remove or render inert any associated contaminates prior to their disposal. Such treatment is time consuming and expensive because it is typically conducted away from the rig location. Consequently, a need exists for improved methods of handling, processing, treating and disposing of drill cuttings produced at a drilling location.

BRIEF SUMMARY OF INVENTION

Applicants' present invention is intended to present a method for the handling, storing and transportation of drill cuttings. The method incorporates a conveying means to transport the drill cuttings removed from the drilling mud slurry to a compacting device. This compacting device is used to crush and compact the drill cuttings into discrete pellets of a desired size and configuration. During this crushing and compacting step, residual oils, synthetics, petroleum distillates, and other liquid contaminates are removed from the "pelletized" drill cuttings resulting in a substantial reduction in the volume of the drill cuttings. In many cases, it is thought that a reduction in cuttings volume of as much as one-third will be achieved after the compaction process.

It has also been found that the cuttings pellets processed in accordance with Applicants' invention often require no other treatment and so the resulting palletized drill cuttings may be disposed of at sea or transported to landfill areas for use or ultimate disposal without harm to the environment. In the case of an offshore drilling rig location, the disposal of drill cuttings at sea, simply by dumping the processed cuttings overboard, is of particular benefit. Valuable platform deck space need not be devoted to the storage of drill cuttings in such a situation and need to transport the stored drill cuttings produced from the borehole to the shore for further treatment and disposal is eliminated.

The pellets produced according to Applicant's invention substantially reduce the volume of drill cuttings at a drilling location. There is also a substantial reduction in the retained fluid volume, including the volume of environmentally harmful fluids, after the cuttings are compacted according to Applicant's invention. Disposal of the cuttings so processed, whether at sea, in a landfill or otherwise, may often be accomplished without the need to further process or treat the compacted cuttings. Such disposal may often be achieved with minimal or no negative impact on the environment from residual fluid contaminants that may remain in the compacted cuttings after processing by the methods and apparatus disclosed herein.

DESCRIPTION OF THE EMBODIMENTS

Figure 1:
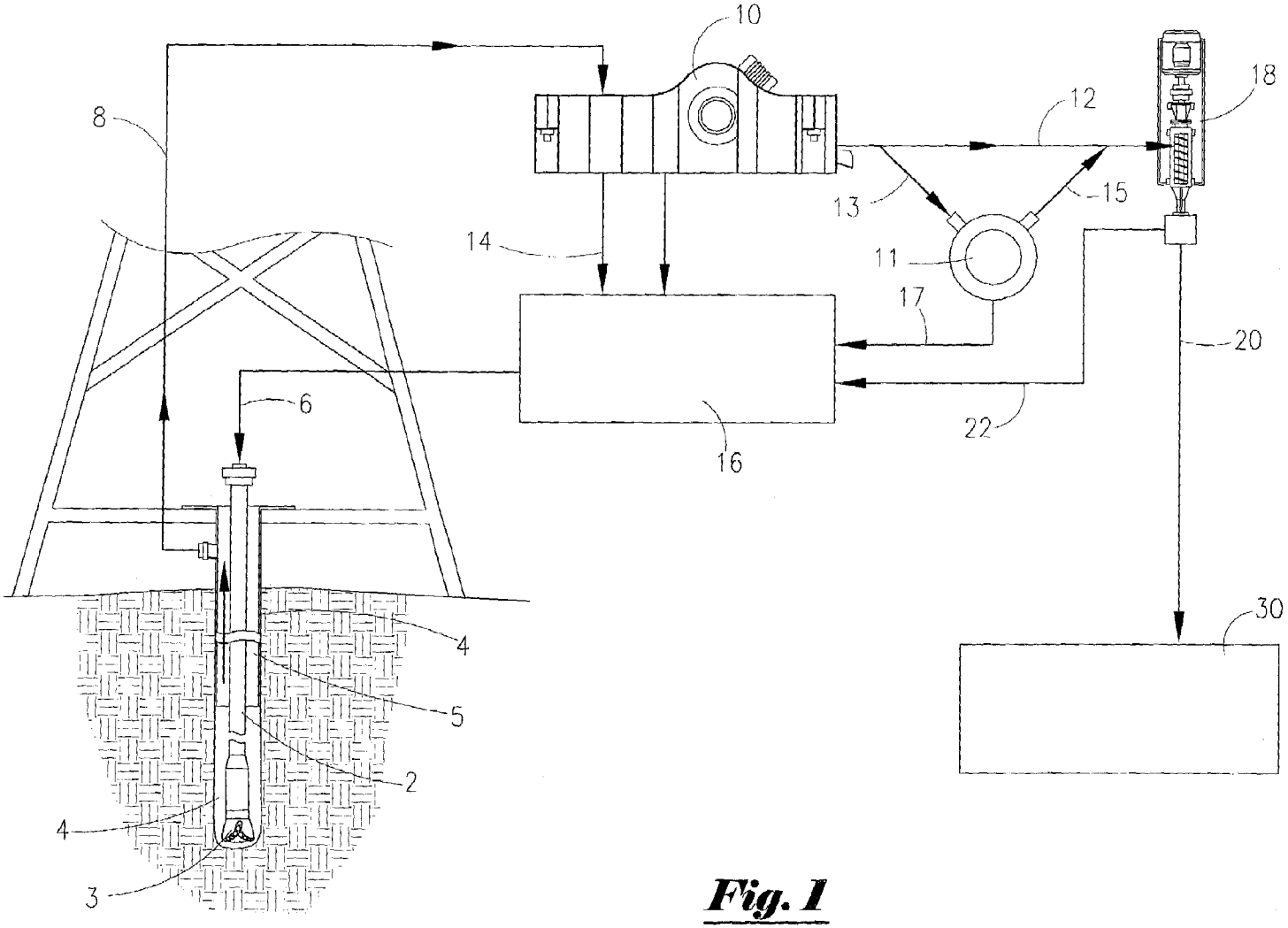
FIG. 1 is a schematic of the drill cutting handling system of Applicants' invention.

FIG. 1 shows a schematic view of the drill cuttings handling, processing and disposal system and method of Applicants' invention. During the drilling of oil and gas wells with rotary drilling rigs, cuttings are produced from the geologic formations encountered by a drill bit 3, mounted on a drill string 2, as drilling advances to create a borehole 4. The cuttings produced by the drill bit 3 are called drill cuttings. The borehole 4 is typically lined with a casing 5 as the drilling advances.

As borehole 4 progresses during drilling, the drilling string 2 is inserted through casing 5 down to the bottom of borehole 4. The drill string 2 forms a portion of the drilling mud line 6 used to pump a liquid slurry know as drilling mud from a drilling mud storage tank 16 through the drill string 2 to the bottom of the borehole 4. The drilling mud conditions and lubricates the borehole 4 to facilitate its advancement and serves to counteract geostatic pressures in the borehole 4 encountered during drilling. Drilling mud may be made up of a number of components depending upon the properties and condition of the geologic formations encountered during drilling. Drilling mud is fluid-based and such fluid-based mud may be water-based, oil or hydrocarbon-based, or synthetic-based depending upon the particular properties desired.

The casing 5 typically extends to the surface of the borehole 4. Drilling mud leaving the drill string 2 is circulated to the surface of the borehole 4 via the casing 5 and carries with it the drill cuttings produced by the drill bit 3 as the borehole 4 is advanced. The drilling mud, and any carried drill cuttings, returned to the surface of the borehole 4 via casing 5 is transported via mud line 8 to a shaker 10 by pumping or other transporting means. The shaker 10 is a screening device that separates the carried drill cuttings from the circulating drilling mud. After the drilling mud is transported through the shaker 10, it is returned, via mud lines 14, to the mud storage tank 16. The cuttings removed from the drilling mud by the shaker 10 are transported, via conveyors 12, to a cuttings compactor 18.

If the cuttings removed by the shaker 10 are excessively wet, they may be selectively transported, via conveyor 13, to a secondary shaker 11 for further removal of retained fluids. Cuttings from secondary shaker 11 are then delivered to the compactor 18 via conveyor 15. The liquids removed from the cuttings by the secondary shaker 11 are then returned to the mud storage tank 16 via mud return line 17.

The cuttings removed from the drilling mud are typically of a gravel-like consistency. Conveyors for transporting such cuttings are well known. Conveyors 12, 13 and 15, used to transport the cuttings to the shaker 10, the secondary shaker 11, or to the compactor 18, may be comprised of gravity lines, trough and auger combinations, belt conveyors, screen conveyors, pneumatic or vacuum lines or any other such device designed to transport the cuttings.

The shaker 10 utilized as described above may be selected from anyone of a number of drill cuttings removal devices. These drill cuttings removal devices include vibratory screen shakers, also know as shale shakers, that are well known in the art. The secondary shaker 11 utilized as described above may also be selected from anyone of a number of well know drill cuttings removal devices. It is contemplated that a Vibro-Energy round separator, such as that manufactured by Sweco, P.O. Box 1509, 8029 US Highway 25, Florence, Ky. 41022 USA, would provide the secondary liquids separation described for the shaker 11 though a vibratory screen shaker or other solids separator could also be utilized.

The compactor 18 of Applicants' invention is utilized to crush and compress the drill cuttings received from shakers 10 and 11 into a plurality of discrete compacted massed bodies drill cuttings of a substantially uniform size such as a pellet, a hard cake or briquette. If necessary, bonding agents such as lignite or bentonite may be added to the compactor 18 along with the collected drill cuttings to facilitate compressing the collected drill cuttings into a plurality of discrete compacted massed bodies drill cuttings. When the drill cuttings are compressed into a plurality of discrete compacted massed bodies of drill cuttings by the compactor 18, liquids such as oil, petroleum distillates, and drilling mud fluids that may have been retained by or with the drilling cuttings after their exposure to shakers 10 and 11 are further separated from the cuttings by the compactor 18. Any such fluids so separated by the compactor 18 are collected and returned to the mud storage tank 16 via return line 22.

After compression, the discrete compacted massed bodies of drill cuttings may be delivered by conveying means 20 to a desired end location 30. In some cases the desired end location 30 will be containers such as storage bags or cuttings boxes for delivery to an ultimate disposal site. Applicant has found that in many cases, the residual liquids and other contaminates contained in the drill cuttings are removed from the pellets during the compacting process by means of compactor 18 is so small that the discrete massed bodies of drill cuttings, commonly called pellets, may be disposed of at sea, simply by dumping them overboard. In those cases, the cost of disposal of the pelletized drill cuttings is reduced substantially because the cost of cuttings containers, transportation, cleaning and residual treatment is eliminated entirely.

The intent of the compactor 18 is to crush and compress the drill cuttings into compacted massed bodies of drill cuttings of a substantially uniform size and shape. Any number of commercially available compactors, including auger extruders, ram extruders and briquetting machines, may be utilized as the compactor 18. Extruders typically have a hopper for delivering material, in this case the drill cuttings, to a trough. A ram or an auger located within the trough then pushes the drill cuttings in the trough through a die having a plurality of openings of a desired size. When the cuttings are pushed through the openings of the die they are thereby crushed and compressed into a discrete massed body of a desired shape.

Extruders produce pressure on cuttings in the range of about 100 psi to about 3000 psi depending upon, as one factor, the size of the openings in the die being used. Dies may have openings of varying sizes and openings in dies may range from about 1/32 of an inch to about 8 inches or more in diameter. Testing has shown that cuttings extruded under pressures in the range of about 300 psi to about 500 psi, through dies having openings in the range of about 1/4 inches to about 3/4 inches, produce compressed cuttings pellets of about 1/4 inches to about 3/4 inches in diameter and that these pellets have a satisfactory compression, size and fluid content for disposal or for being transported in storage bags or other containers. It is thought that a single extruder could process eight to ten tons of cuttings per hour. One example of an extruder that may be utilized as the compactor 18 is the Terrrier Extruder manufactured by The Bonnot Company, 1520 Corporate Woods Parkway, Uniontown, Ohio 44685, USA.

Examples of briquetting machines that may be utilized as the compactor 18 are those manufactured by K. R. Komarek Inc., 1825 Estes Avenue, Elk Grove Village, Ill. 60007, USA. Such briquetting machines have a hopper for delivering a quantity of material, in this case drill cuttings, between pairs of opposing rollers. These rollers have plurality of uniformly spaced, selectively sized, indentations. When the drill cuttings are moved between the opposing rollers they are squeezed into the recesses of the rollers and thereby compacting the drill cuttings into briquettes of a desired size and shape. While briquetting machines will produce briquettes in a variety of different sizes, it is thought that briquetting machines that produce briquettes of about 3/4 of an inch to about 1 1/2 inches in width, of about 1 inch to about 2 1/2 inches in length and of about 1/2 of an inch to about 1 inch in thickness would provide briquettes of massed drill cuttings having a satisfactory compression, size and water content for disposal or for being transported in storage bags or other containers.

Compressing the cuttings into discrete pellets or briquettes of substantially uniform dimensions by means of compactor 18 serves to substantially reduce the volume of the drill cuttings. In many cases, it has been found that a reduction in cuttings volume of as much as one-third will be achieved after the compaction process. Such significant volume reductions result in decreased cost of handling, processing and disposing of drill cuttings.

The formation of the drill cuttings into discrete pellets by compression as described herein also serves to further remove any retained fluids and drill fluids from the cuttings, whether such fluids are oil or hydrocarbon-based, water-based or synthetic-based fluids. It has been found that cuttings pellets processed in accordance with Applicants' invention often require no further treatment prior to their disposal. Compacted pelletized drill cuttings often may be disposed of at sea or transported to landfill areas for ultimate disposal without posing harm to the environment. In the case of an offshore drilling rig location, the disposal of drill cuttings at sea, simply by dumping the processed pelletized cuttings overboard, is of particular benefit. Valuable platform deck space need not be devoted to the storage of drill cuttings in such a situation and the need to transport the stored drill cuttings produced from the borehole to the shore for further treatment and disposal is eliminated.

While the system shown is specifically intended for use in handling, processing and disposing drill cuttings produced during the drilling of oil and gas wells, it will be apparent from this disclosure that the system shown and described might be readily modified for use in other applications. One such application is for use in the handling, compacting and storage of solids removed from a liquid waste collection area during cleanup. Examples of such waste collection areas include oilfield waste storage pits and tanks and the hulls of barges or ships.

In such use, the compactor 18, the shakers 10 and 11, if necessary; return lines 14, 17, 22; and the associated conveyors 12, 13, 15, 20, may be transported and assembled in the described manner at a desired location such as a storage tank site. At such storage tank site, the system could be assembled to compress and de-water solids that are removed during the tank cleaning process. Since a storage tank site does not necessarily have drilling system, a well bore and a mud circulating system as described above, a solids delivery line for delivering tank liquids and liquid borne solids to the shaker 10 would replace the mud line 8 depicted in FIG. 1 and the liquid return lines 14, 17 and 22 would be directed to return to the tank being cleaned rather than to a mud storage tank 16. Otherwise the system utilized for compacting and de-watering the solids removed from a tank during cleanup is essentially that depicted in FIG. 1 for handling drill cuttings.

The solids removed from the tank during cleaning are collected and delivered to compactor 18, compressed to pellets or briquettes of desired dimensions and conveyed to a desired storage location, in many cases without further treatment of the pellets produced during the compaction process. If necessary, bonding agents such as lignite or bentonite may be added to the solids to facilitate compressing the collected solids into pellets or briquettes. The pellets or briquettes may then be placed in containers for delivery by conveying means 20 to a desired location 30. Such a location 30 may include a landfill, an offshore dumping location or an interim site for further processing, if such is required or desired.

It is thought that the drill cuttings handling system and method depicted herein and its attendant advantages will be understood from the foregoing description and changes may be made in the form, construction and arrangement of the parts thereof without departing from the spirit and scope of the invention or sacrificing all of its material advantages.

We claim:

1. A method for removing, handling, processing and disposing of drill cuttings from the drilling mud of a drilling mud system of an oil and gas well drilling rig, comprising the steps of:

(a) separating drill cuttings from the drilling mud;

(b) then, transporting the drill cuttings so separated to a compactor;

(c) then, compacting the drill cuttings so separated into a plurality of discrete compacted bodies of drill cuttings and thereby reducing substantially the fluids contained in the drill cuttings; and (d) then, delivering said compacted bodies of drill cuttings to a desired end location.

2. The method as recited in claim 1 wherein, said drilling mud is delivered to a drilling mud storage tank after said step of separating said drill cuttings from the drilling mud is completed.

3. The method as recited in claim 2, wherein the fluids produced from said step of compacting the so separated drill cuttings into a plurality of discrete compacted bodies are conveyed to said mud storage tank.

4. The method as recited in claim 3 wherein, said compactor m said step of transporting said the drill cuttings so separated to a compactor includes an extruder.

5. The method as recited in claim 4, wherein, said extruder compresses said drill cuttings at a range of pressures between about 300 psi to about 500 psi.

6. The method as recited in claim 5, wherein, said extruder extrudes compacted bodies of said drill cuttings having a diameter in the range of about ⅜ of an inch to about ¾ of inch.

7. The method as recited in claim 3 wherein, said compactor in said step of transporting said the drill cuttings so separated to a compactor includes a briquetting machine.

8. The method as recited in claim 3 wherein, after said step of compacting the drill cuttings so separated into a plurality of discrete compacted bodies of drill cuttings and thereby reducing substantially the fluids contained in the drill cuttings the method includes the additional step of filling storage bags with said discrete compacted bodies of drill cuttings before said step of delivering said compacted bodies of drill cuttings to a desired end location.

9. The method as recited in claim 3 wherein, the step of conveying said discrete compacted bodies of said, drill cuttings to a desired storage area includes dumping said discrete compacted bodies of said drill cuttings overboard.

10. A method for handling solids retained in a liquid slurry comprising:

(a) providing a means for separating solids from the liquid slurry;

(b) providing a means for compacting said solids so separated from said liquid slurry into discrete massed bodies;

(c) transporting said solids so separated from said liquid slurry to said a compactor means;

(d) compacting said solids into discrete massed bodies of said separated solids and thereby producing a substantial reduction in the fluid retained in said solids; and (e) transporting said discrete massed bodies of said separated solids to a desired end location.

11. The method as recited in claim 10, further comprising the step of adding a bonding agent to said solids so separated from said liquid slurry so as to facilitate compacting said solids into discrete massed bodies of said separated solids.

12. The method as recited in claim 11 wherein, said step of transporting said discrete massed bodies of said separated solids to a desired end location includes dumping said discrete massed bodies of said separated solids at sea.

13. The method as recited in claim 11 wherein, said step of transporting said discrete massed bodies of said separated solids to a desired end location includes delivering said discrete massed bodies to a landfill.

14. A method of disposing drill cuttings produced from the drilling mud of a drilling mud system of an oil and gas well drilling rig, comprising the steps of:

(a) providing a drilling rig;

(b) producing a borehole with said drilling rig and thereby producing a quantity of drill cuttings;

(c) providing a drilling mud system for circulating drilling mud through said borehole and thereby removing said drill cuttings from said borehole;

(d) separating said drill cuttings from said circulating drilling mud;

(e) compacting said drill cuttings so separated into a plurality of discrete compacted bodies and thereby substantially removing any fluids retained in said drill cuttings and reducing the volume of said drill cuttings; and (f) then, delivering said discrete compacted bodies to a desired end location.

15. The method as recited in claim 14 comprising the additional step of delivering said fluids removed during the step of compacting said drill cuttings to said drilling mud system.

16. The method as recited in claim 15 wherein, said drilling rig is situated in an offshore location.

17. The method as recited in claim 16 wherein, the step of delivering said discrete compacted bodies to a desired end location includes dumping said discrete compacted bodies offshore.

18. The method as recited in claim 17, wherein, the step of compacting said drill cuttings so separated includes extruding said drill cuttings so separated with an extruder.

19. The method as recited in claim 18 wherein, said bonding agent is bentonite.

20. The method as recited in claim 17 wherein, the step of compacting said drill cuttings so separated includes compressing said drill cuttings so separated into briquettes by means of a briquetting machine.

21. The method as recited in claim 15 wherein, the step of delivering said discrete compacted bodies to a desired end location includes delivering said discrete compacted bodies to a landfill.

22. The method as recited in claim 15 wherein, the step of compacting said drill cuttings so separated includes extruding said drill cuttings so separated with an extruder.

23. The method as recited in claim 22 further comprising the step of adding a bonding agent to said drill cuttings separated from said circulating drilling mud so as to facilitate the step of compacting said drill cuttings so separated into a plurality of discrete compacted bodies.

24. The method as recited in claim 15 wherein, the step of compacting said drill cuttings so separated includes compressing said drill cuttings so separated into briquettes by means of a briquetting machine.

25. The method as recited in claim 24 further comprising the step of adding a bonding agent to said drill cuttings separated from said circulating drilling mud so as to facilitate the step of compacting said drill cuttings so separated into a plurality of discrete compacted bodies.

26. The method as recited in claim 15 further comprising the step of adding a bonding agent to said drill cuttings separated from said circulating drilling mud so as to facilitate the step of compacting said drill cuttings so separated into a plurality of discrete compacted bodies.

* * * * *